United States Patent [19]

Tilley

[11] Patent Number: 4,730,830

[45] Date of Patent: Mar. 15, 1988

[54] GOLF CLUB

[76] Inventor: Gordon J. Tilley, Manor Farm, 4 Bennetts Hill, Dunton Bassett, Lutterworth, Leicestershire, England

[21] Appl. No.: 849,909

[22] Filed: Apr. 9, 1986

[30] Foreign Application Priority Data

Apr. 10, 1985 [GB] United Kingdom ..... 8509185

[51] Int. Cl.[4] ..... A63B 53/04

[52] U.S. Cl. ..... 273/171; 273/173

[58] Field of Search ..... 273/173, 78, 167 H, 273/174, 171, 172, 170, 167 F, 167 J

[56] References Cited

U.S. PATENT DOCUMENTS

| | | | |
|---|---|---|---|
| 699,624 | 5/1902 | Kempshall | 273/78 |
| 1,094,599 | 4/1914 | Samson | 273/78 |
| 1,213,382 | 1/1917 | Kent | 273/171 |
| 1,318,325 | 10/1919 | Klin | 273/171 |
| 3,218,072 | 11/1965 | Burr | 273/78 |
| 3,466,047 | 9/1969 | Rodia et al. | 273/171 |
| 3,567,228 | 3/1971 | Lynn | 273/173 X |
| 3,652,094 | 3/1972 | Glover | 273/173 X |
| 3,847,399 | 11/1974 | Raymont | 273/78 X |
| 4,085,934 | 4/1978 | Churchward | 273/171 |
| 4,199,144 | 4/1980 | Skelly | 273/173 X |
| 4,489,945 | 12/1984 | Kobayashi | 273/167 H |
| 4,535,990 | 8/1985 | Yamada | 273/173 |
| 4,630,826 | 12/1986 | Nishigaki et al. | 273/173 |
| 4,655,458 | 4/1987 | Lewandowski | 273/171 |

FOREIGN PATENT DOCUMENTS

| | | | |
|---|---|---|---|
| 1821 | of 1909 | United Kingdom | 273/173 |
| 982188 | 2/1965 | United Kingdom | 273/173 |
| 1016895 | 1/1966 | United Kingdom | 273/173 |
| 1227948 | 4/1971 | United Kingdom | 273/173 |
| 2016281 | 9/1979 | United Kingdom | 273/173 |

*Primary Examiner*—George J. Marlo

*Attorney, Agent, or Firm*—Banner, Birch, McKie & Beckett

[57] ABSTRACT

A golf club having a hollow head (10) is filled with a filling material formed with a multiplicity of blind bores (18). The bores are spaced apart in the filling material, and the open ends of the bores normally are covered by an insert (14*a*) which forms the striking surface of the golf club head. The insert is detachable from the hollow head to permit access to the open ends of the blind bores. The blind bores can receive weights to achieve a desired weight and balance of the hollow head. The weights are removable when the insert is detached from the hollow head. The front ball striking surface of the insert is defined by a layer of woven plastic impregnated with a liquid plastic material, such as epoxy resin. The rear surface of the insert includes a layer of compacted, folded strands or ribbons of carbon fiber. When a foam filling material is injected into the hollow club head, the foam will reach and penetrate interstices of the folded carbon strands.

5 Claims, 5 Drawing Figures

GOLF CLUB

This invention relates to golf clubs and more particularly to an insert serving as the striking surface for a golf club head. The expression "golf club" is to be taken as referring indifferently to woods or irons.

One aspect of the present invention provides a golf club, a surface of which arranged to strike the ball comprises a high strength, wear-resistant plastics material such as Kevlar. A surface element may be provided which is woven from filaments of the plastics material and the element may be backed by an impact resistant material co-extensive with the rear face of the element. The impace resistant material may be carbon which may be in the form of one or more ribbons or strands of carbon fibre, looped and compacted to form a unitary body.

In a preferred application of this aspect of the invention the element, with or without its backing, takes the form of an insert which, on the appropriate side of a golf club head, is received into a rebate so as to be flush with the exterior of the head. If the head is hollow the insert may be fixed in position in the rebate by a suitable adhesive before the head is filled with a suitable, hardenable foam in known manner.

Another aspect of the invention provides a golf club having an insert provided with a striking surface and which, on the appropriate side of the golf club head, is received into a rebate so as to present the striking surface flush with the exterior of the head, wherein the head is formed with one or more recesses normally covered by said insert, or a number of such recesses receiving a weight in order to achieve a desired balance of the head.

Embodiments of the invention will now be described by way of example, with reference to the accompanying diagrammatic drawings, in which.

Figure 1:
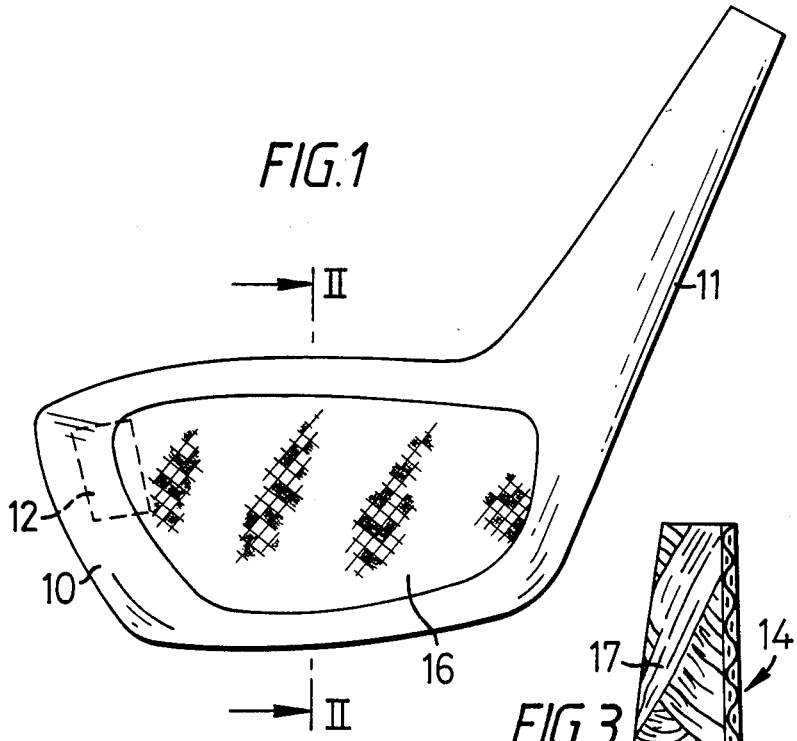
FIG. 1 is a side elevation of a golf club head.
Figure 3:
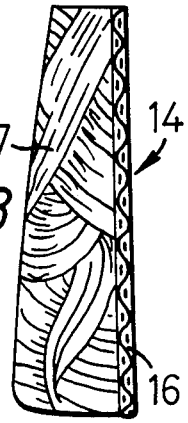
FIG. 3 is an end elevation on an enlarged scale of the insert.
Figure 2:
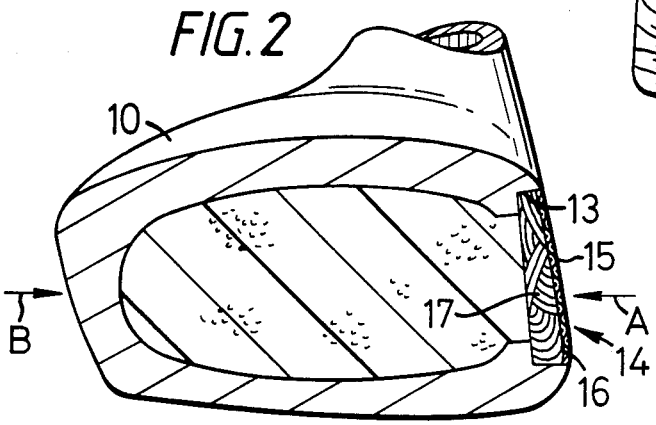
FIG. 2 is a sectional elevation taken on the line II—II of FIG. 1.

Referring first to FIGS. 1 to 3, the hollow head 10 of a golf club of the type known as a "wood" has an integral, tubular hosel to receive the shank (not shown) and one side face indicated by the arrow A in FIG. 2 is designed for striking the ball with the other face B trailing. (For a left-handed player, the shape of the head, as shown in FIG. 2, would be reversed with the face A to the left, as viewed, and the face B to the right).

The head 10 is hollow and moulded from a suitable plastics material, which may be reinforced. For perimeter weighting one or more weights 12 are inserted in the leading end of the head and when correctly positioned to achieve the desired balance, are fixed in position by a suitable adhesive.

As so far described the head 10 is conventional. However, the striking face A of the head 10 has an opening the perimeter of which is formed with a rebate 13 to receive a correspondingly shaped insert 14 so that the external surface 15 of the insert is flush or continuous with the external surface of the remainder of the head 10.

The insert 14 is shown on a larger scale in FIG. 3 and it comprises a suitably shaped piece of woven Kevlar 16, or another high strength, wear-resistant plastics material. The woven Kevlar 16 is preferably impregnated with a liquid plastics material of high strength when set, such as an epoxy resin, this forming an external surface (not shown) for the piece of woven Kevlar 16.

The piece of woven Kevlar 16 is backed by an impact resistant body of carbon material 17 co-extensive with its rear surface and also received in the rebate 13. The body of carbon material 17 may, as shown, be made by laying up and compacting one or more strands or ribbons of carbon fibre.

After fixing the insert 14 in the rebate 13 by means of a suitable resin based adhesive such as Araldite (Registered Trade Mark) a settable foam is injected, in known manner, through a suitable hole (not shown) in the head or hosel. The foam will reach and preferably integrate with the body of carbon material 17, e.g. by penetrating interstices of the folded strands.

Figure 4:
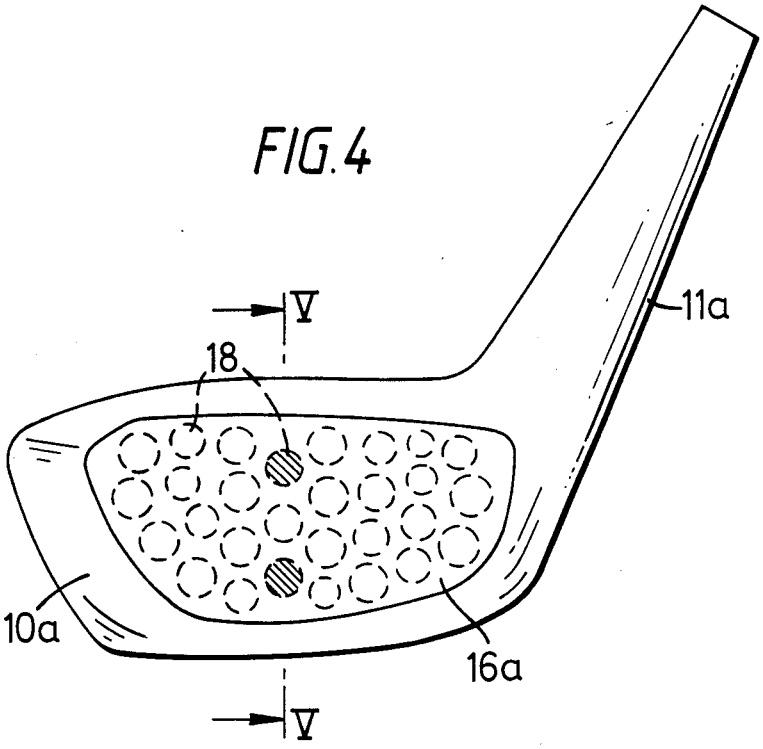
FIG. 4 is a side elevation of a modified golf club head.
Figure 5:
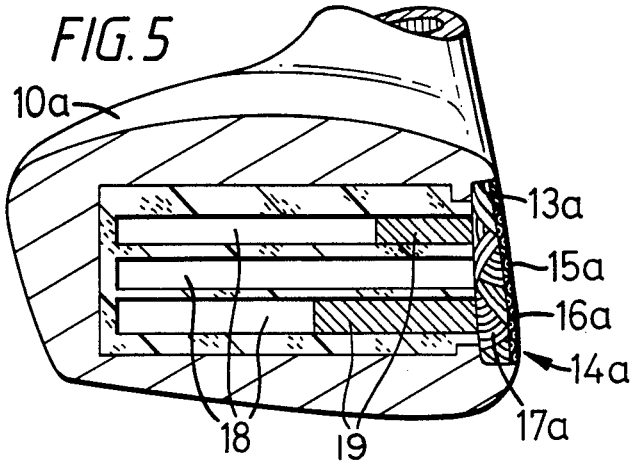
FIG. 5 is a sectional elevation taken on the line V—V of FIG. 4.

Referring now to FIGS. 4 and 5, there is shown a modified hollow head **10*a* of a golf club which is similar to that described with reference to FIGS. 1 to 3 and in which like parts are designated like reference numerals with the addition of suffix 'a'. However, in the modified construction the head is formed with a multiplicity of elongate blind bores 18. The bores 18 are spaced apart within the area covered by the insert 14 each of which bores has its open end at the base of the rebate 13*a*. It is envisaged that the head 10*a*** may be formed with a greater or lesser number of bores which may have a different cross-sectional shape and/or different dimensions to those illustrated.

The bores 18 are provided to receive weights 19 and one or more weights are inserted into selective ones of the bores so as to achieve a desired balance of the head. The or each weight may be fixed in position by a suitable adhesive or may simply be a force fit in the associated bore. In the latter case each weight may be removable in order to alter the balance of the head. To this end, the insert **14*a* may be detachably connected in the rebate 13*a* by suitable fasteners. This latter modification also is applicable to the previous construction described with reference to FIGS. 1 to 3. Where a detachable insert is provided the angle at which external surface 15, 15*a*** is presented can be varied by suitable shim elements (not shown) located in the rebate to raise a selected portion of the base of the recess in which the insert is seated.

What is claimed is:

1. A golf club comprising:

a hollow head;

a filling material having multiplicity of spaced apart blind bores disposed in said hollow head;

an insert detachably mounted on said hollow head, said insert normally covering the open ends of said bores and permitting access to said bores when detached from said hollow head; and at least one weight removably receivable in respective ones of said bores when said insert is detached for adjusting the balance of said hollow head.

2. A golf club according to claim 1 wherein a surface of said insert forms a ball engaging surface comprising a surface element which is woven from filaments of plastics material.

3. A golf club according to claim 2, wherein said surface element is backed by an impact-resistant material coextensive with a rear face of said surface element.

4. A golf club according to claim 3, wherein said impact-resistant material comprises carbon in the form of ribbons or strands of carbon fiber looped and compacted to form a unitary body.

5. A golf club according to claim 1, wherein said insert is received in a recess formed in said hollow head to present said ball engaging surface flush with the exterior of said hollow head.

* * * * *